US010111525B2

(12) United States Patent
Sander et al.

(10) Patent No.: US 10,111,525 B2
(45) Date of Patent: Oct. 30, 2018

(54) SEAT, IN PARTICULAR AN OFFICE CHAIR

(71) Applicant: Haworth, Inc., Holland, MI (US)

(72) Inventors: Armin Sander, Furth (DE); Martin Potrykus, Bamberg (DE)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 15/715,572

(22) Filed: Sep. 26, 2017

(65) Prior Publication Data

US 2018/0014646 A1 Jan. 18, 2018

Related U.S. Application Data

(63) Continuation of application No. 15/297,515, filed on Oct. 19, 2016, now Pat. No. 9,826,836, which is a (Continued)

(30) Foreign Application Priority Data

Jun. 8, 2011 (DE) ..... 10 2011 104 972

(51) Int. Cl.
*A47C 1/02* (2006.01)
*A47C 1/032* (2006.01)
(Continued)

(52) U.S. Cl.
CPC ..... *A47C 1/02* (2013.01); *A47C 1/023* (2013.01); *A47C 1/03255* (2013.01);
(Continued)

(58) Field of Classification Search
None
See application file for complete search history.

(56) References Cited

U.S. PATENT DOCUMENTS 3,353,869 A 11/1967 Getz et al.
3,476,169 A 11/1969 Militano
(Continued)

FOREIGN PATENT DOCUMENTS

CN 2168479 6/1994
CN 1331940 1/2002
(Continued)

OTHER PUBLICATIONS

International Search Report and Written Opinion of International Application PCT/EP2012/002434, dated Sep. 28, 2012.

*Primary Examiner* — David E Allred
(74) *Attorney, Agent, or Firm* — Warner Norcross + Judd LLP

(57) ABSTRACT

The invention relates to a seat (1), in particular an office chair, comprising a seat support (3) for a seating surface (6) and comprising a backrest support (4) of a backrest (5), which is held on the seat support (3) so as to be able to move in a tiltable manner to the side, wherein the backrest support (4) comprises two support aims (4*a*, 4*b*) which are configured to be flexible and/or articulated laterally and spaced apart from one another. Preferably, the seating surface (6) and/or the backrest (5) comprises a curved seat shell and/or backrest shell (6*a*, 5*a*) provided with a cover (6*b*, 5*b*) with a number of flexible curved ribs (15, 16) on the edge of the shell, wherein the cover is stretched by the seat shell and/or backrest shell (6*a*, 5*a*) such that when the cover (6*b*, 5*b*) is loaded, the bending of the curved ribs (15, 16) is altered.

4 Claims, 10 Drawing Sheets

Figure 1:
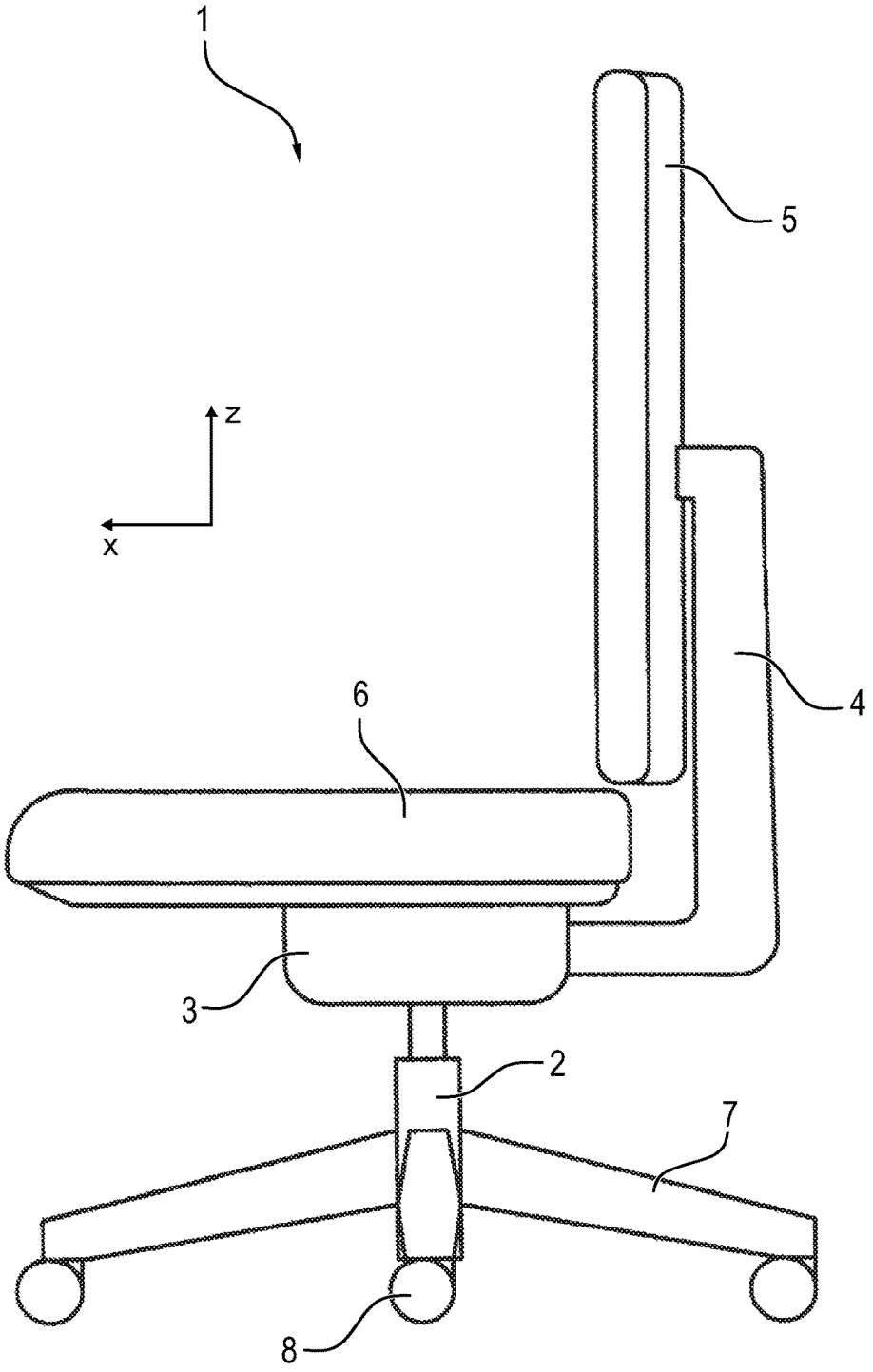

Related U.S. Application Data continuation of application No. 14/123,617, filed as application No. PCT/EP2012/002434 on Jun. 8, 2012, now Pat. No. 9,504,325.

(51) Int. Cl.

| | |
|---|---|
| ***A47C 1/023*** | (2006.01) |
| ***A47C 7/40*** | (2006.01) |
| ***A47C 7/44*** | (2006.01) |
| ***A47C 7/02*** | (2006.01) |
| ***A47C 7/46*** | (2006.01) |
| ***A47C 7/00*** | (2006.01) |
| ***A47C 7/54*** | (2006.01) |

(52) U.S. Cl.

CPC ..... *A47C 7/004* (2013.01); *A47C 7/006* (2013.01); *A47C 7/02* (2013.01); *A47C 7/40* (2013.01); *A47C 7/445* (2013.01); *A47C 7/46* (2013.01); *A47C 7/54* (2013.01)

(56) References Cited

U.S. PATENT DOCUMENTS

| | | | | |
|---|---|---|---|---|
| 4,049,315 | A | 9/1977 | Jacobson | |
| 4,408,800 | A | 10/1983 | Knapp | |
| 4,556,254 | A | 12/1985 | Roberts | |
| 4,658,807 | A | 4/1987 | Swain | |
| 4,744,603 | A | 5/1988 | Knoblock | |
| 5,026,116 | A | 6/1991 | Dal Monte | |
| 5,320,410 | A | 6/1994 | Falks et al. | |
| 5,403,067 | A | 4/1995 | Rajaratnam | |
| 5,586,808 | A | 12/1996 | Oelke | |
| 5,645,321 | A | 7/1997 | Seroldi | |
| 5,782,536 | A * | 7/1998 | Heidmann | A47C 1/023 297/300.2 |
| 5,826,937 | A | 10/1998 | Massara | |
| 5,951,109 | A | 9/1999 | Roslund et al. | |
| 5,957,534 | A | 9/1999 | Wilkerson | |
| 5,988,757 | A | 11/1999 | Vishey et al. | |
| 6,572,190 | B2 | 6/2003 | Koepke et al. | |
| 6,761,403 | B2 | 7/2004 | Pal et al. | |
| 6,910,736 | B2 | 6/2005 | White | |
| 6,971,717 | B1 | 12/2005 | Rhodes | |
| 7,032,971 | B2 | 4/2006 | Williams | |
| 7,334,845 | B2 | 2/2008 | Peterson et al. | |
| 7,396,079 | B2 | 7/2008 | Heidmann et al. | |
| 7,896,438 | B2 | 3/2011 | Whelan et al. | |
| 7,909,402 | B2 | 3/2011 | Chu et al. | |
| 3,029,060 | A1 | 10/2011 | Parker et al. | |
| 8,152,215 | B1 | 4/2012 | Tsumiyama | |
| 8,544,957 | B2 | 10/2013 | Lin | |
| 8,590,978 | B2 * | 11/2013 | Jaranson | B60N 2/643 297/218.1 |
| 8,622,472 | B2 | 1/2014 | Rajaratnam | |
| 8,690,255 | B2 | 4/2014 | Yamaki | |
| 8,973,990 | B2 | 3/2015 | Krupiczewicz et al. | |
| 9,578,968 | B2 | 2/2017 | Masunaga et al. | |
| 2001/0008955 | A1 | 7/2001 | Garth | |
| 2002/0130540 | A1 | 9/2002 | Rajasingham | |
| 2002/0190552 | A1 | 12/2002 | Koepke et al. | |
| 2003/0151287 | A1 | 8/2003 | Ueda | |
| 2004/0007910 | A1 | 1/2004 | Skelly | |
| 2004/0104610 | A1 | 6/2004 | Jaskot et al. | |
| 2004/0195882 | A1 | 10/2004 | White | |
| 2004/0256899 | A1 | 12/2004 | Moore et al. | |
| 2005/0179292 | A1 | 8/2005 | Knoblock et al. | |
| 2006/0103214 | A1 | 5/2006 | Andersson et al. | |
| 2006/0181126 | A1 | 8/2006 | Eysing | |
| 2006/0255635 | A1 | 11/2006 | Iijima et al. | |
| 2007/0102987 | A1 | 5/2007 | Chen | |
| 2008/0284229 | A1 | 11/2008 | Masunaga et al. | |
| 2008/0296945 | A1 | 12/2008 | Bedford et al. | |
| 2009/0085388 | A1 | 4/2009 | Parker et al. | |
| 2009/0102268 | A1 | 4/2009 | Schmitz et al. | |
| 2009/0261644 | A1 | 10/2009 | Piretti | |
| 2010/0187882 | A1 | 7/2010 | Chen | |
| 2012/0061988 | A1 | 3/2012 | Jaranson et al. | |
| 2012/0299350 | A1 | 11/2012 | Willingham | |
| 2013/0221724 | A1 | 8/2013 | Fowler | |
| 2014/0062154 | A1 | 3/2014 | Minino et al. | |
| 2014/0077547 | A1 | 3/2014 | Huttenhuis | |
| 2014/0117738 | A1 | 5/2014 | Takahashi et al. | |
| 2014/0183914 | A1 | 7/2014 | Cvek | |
| 2014/0232158 | A1 | 8/2014 | Sano | |
| 2014/0265493 | A1 | 9/2014 | Machael | |
| 2016/0029801 | A1 | 2/2016 | Potrykus et al. | |

FOREIGN PATENT DOCUMENTS

| | | |
|---|---|---|
| CN | 1470420 | 1/2004 |
| CN | 1564666 | 1/2005 |
| CN | 1575142 | 2/2005 |
| CN | 101715310 | 5/2010 |
| DE | 102007002284 | 7/2008 |
| DE | 102008009509 | 8/2009 |
| DE | 102011100708 | 11/2012 |
| EP | 1232703 | 8/2002 |
| EP | 1693248 | 8/2006 |
| EP | 1785070 | 5/2007 |
| EP | 1911374 | 4/2008 |
| EP | 1946676 | 7/2008 |
| WO | 9212654 | 8/1992 |
| WO | 9848670 | 11/1998 |
| WO | 9848671 | 11/1998 |
| WO | 0022961 | 4/2000 |
| WO | 03063651 | 8/2003 |
| WO | 2010120139 | 10/2010 |
| WO | 20120167940 | 12/2012 |

* cited by examiner

SEAT, IN PARTICULAR AN OFFICE CHAIR

The invention relates to a seat, in particular an office chair, as claimed in the preamble of claim 1. Such an office chair is disclosed, for example, in WO 98/48670.

An office chair is able to have a substantial influence on the seating dynamics. Whilst in a rigid chair only static seating is possible, in an office chair dynamic seating is facilitated due to the mechanisms and possibilities of adjustment. To this end, an office chair with a movable seating surface and movable backrest is disclosed, for example, in DE 101 22 946 C1, wherein the seating surface and the backrest are coupled together by a so-called synchronous mechanism. This permits a synchronous movement of the seating surface and/or the seat with the backrest, when said backrest is inclined to the rear from a raised position as a result of the action of force on the part of the user. The tilting motion of the seating surface and/or the backrest is generally restricted in such synchronous mechanisms to a forward and rearward inclination.

The office chair disclosed in WO 98/48670 comprises, in addition to the synchronous mechanism for forward and rearward inclination, a tilting mechanism for a lateral, i.e. sideways tilting movement of the backrest. To this end, a substantially horizontally extending support arm of the backrest support of the backrest is guided in a spring-loaded rotary bearing of the seat support, so that the horizontal support arm of the backrest support forms the rotational axis extending below the seating surface and/or the seat.

The object of the invention is to provide a seat, in particular an office chair, which permits a high degree of seating comfort and in a simple manner an adaptation to different seating positions.

This object is achieved according to the invention by the features of claim 1. Advantageous variants, developments and embodiments form the subject-matter of the sub-claims.

The seat serving, in particular, as an office chair comprises a seat support and a backrest support for the backrest. Said backrest is held on the seat support so as to be able to move in a tiltable manner to the side or sideways, i.e. from an initial vertical position in a direction transversely to a forward and rearward inclination which is preferably also provided, by the backrest support comprising two support arms which are configured to be flexible and/or articulated laterally and spaced apart from one another.

The support arms extend upwards in the vertical direction from the seat support located below the actual seating surface, expediently approximately as far as the central region of the backrest and preferably the rear face thereof. The two support arms of the backrest support extend spaced apart from one another and are connected together with the support ends thereof on the seat side, via a connecting element on the seat side and with the support ends thereof on the backrest side, via a connecting element on the backrest side. The connecting elements which extend preferably substantially horizontally serve for connecting, i.e. for fastening or holding, the support arms on the seat support, on the one hand, and on the backrest, on the other hand. The connecting elements may be formed integrally or in one piece with the support arms. Also, the connecting elements may be dispensed with and the support ends of the support arms may be directly connected to the seat support and/or the backrest.

Preferably, the support arms do not extend in parallel, but in a V-shape relative to one another, wherein the spacing of the support ends of the support arms on the backrest side is greater than the spacing of the ends of the support arms on the seat side relative to one another. As a result of this V-shaped and/or trapezoidal arrangement of the support arms, a lateral (sideways) inclination of the backrest in practice inevitably leads to a corresponding inclination of the backrest upper and lower edge in the corresponding lateral direction. The inclination or tilting movement of the backrest accordingly takes place in combination with an at least slight rotational movement of the backrest about a (virtual) rotational axis located between the support ends of the support arms.

In a particularly advantageous embodiment, the support arms extend in the direction of the seating surface and extend in this case in a V-shaped or trapezoidal manner relative to one another. The support arms extend in the direction of the seating surface toward one another. In other words—relative to a Cartesian coordinate system in which the seating surface is located in the xy-plane and the backrest extends in the z-direction and the arm length of the support arms is oriented in the z-direction, the arm depth of the support arms in the y-direction and the arm width of the support arms in the x-direction—the cross section of the two support arms located in the xy-plane extends along the arm width thereof at an angle relative to the center of the seating surface.

Due to this V-shaped path of the support arms along the arm width thereof toward the seating surface, as a result of the laterally oriented force, the backrest moves on a circular path and/or along a circular arc. The radius of said circular arcuate backrest movement, which may be adapted to the curved contour of the edge of the seating surface facing the backrest, is adjusted, dimensioned or designed such that the backrest which is inclined sideways neither perceptibly runs into the seating surface nor perceptibly moves away therefrom.

In the embodiment of the rigid connection of the support arms to the seat support and to the backrest, the support arms are expediently made from a flexible material, for example from a suitable plastics material or from metal, for example a spring steel. The support arm width of the flexibly configured support arms is in this case greater than the support arm depth thereof. As a result, it is ensured that bending the support arms as a result of the action of force always takes place only laterally, i.e. to the left or right, and not in the transverse direction thereto, i.e. to the front or rear.

In this variant with flexible support arms, the support arm depth thereof in the region of the connection to the backrest is smaller than in the region of the connection thereof to the seat support. In this embodiment, expediently the support arm depth continuously reduces from the seat support in the vertical direction to the backrest connection. This leads to increased torsional rigidity from the backrest connection along the support arms to the connection thereof on the seat side. In other words, the flexibility along the support arms increases from the connection thereof on the seat side toward the connection on the backrest side.

An alternative variant of the connection provides articulated connections to the connecting element on the backrest side and/or directly to the backrest, on the support ends of the support arms on the backrest side. Alternatively or additionally, said articulated connections may also be provided on the support ends of the support arms on the seat side and, in turn, in the connection with the connecting element on the seat side and/or directly on the seat support.

In an advantageous development, the seat comprises a substantially curved support shell (seat shell) as a seat and a cover. The support shell and/or seat shell comprises on the edge of the shell or at the end of the shell, a number of flexible curved ribs which are raised as a result of the curved shape. The cover is stretched by the support shell, such that when the cover is loaded, the bending of the curved ribs and/or the support shell is altered.

Alternatively, or preferably additionally, the backrest comprises in a similar manner a curved bearing shell (backrest shell) provided with a cover, with a number of flexible curved ribs on the edge of the shell and/or at the end of the shell, which are raised as a result of the curved shape. The cover is in turn stretched by the bearing shell and/or backrest shell, such that when the cover is loaded, the bending of the curved ribs and/or the bearing shell is altered.

The support shell of the seating surface and/or the bearing shell of the backrest comprises a central seat recess and/or backrest recess, which forms a seat opening and/or backrest opening on the side of the shell base, and which is covered by means of the seat cover and/or backrest cover. Expediently, the support arms of the backrest support flank the backrest opening in the vertical direction, whilst the connecting element on the backrest side flanks the backrest opening at the top in the horizontal direction. The backrest opening is thus advantageously enclosed at the top and to the side and thus enclosed on three sides by the backrest support in the manner of a frame.

The seat support expediently stabilizes the seat opening on at least two opposing opening edges. As a result, a rigid central piece of the support shell is formed. Due to the bending, the curved ribs are raised relative to the seat opening and/or relative to the central piece. In other words, the free end of the respective curved rib is not located in the plane in which the central piece and/or the seat opening is located. Preferably, curved ribs opposing one another are raised in the same direction relative to the central piece.

The curved ribs are expediently formed by a number of slots incorporated on the peripheral side in the support shell and/or bearing shell. The slots extend from the outer edge of the shell preferably on three shell sides inwards in the direction of the central seat opening and/or backrest opening, without however reaching said opening. The shell sides facing one another of the support shell and bearing shell, i.e. the rear seat shell edge and lower backrest shell edge, remain unslotted.

The cover which forms the seating surface directly or by means of an additional cushion, is located between the opposing curved ribs. The cover is connected to each of the curved ribs, expediently in the region of the respective free ends, and preferably covers the seat opening and/or backrest opening such that—viewed in cross section along the width of the support shell and/or bearing shell—the cover forms a secant of the seat shell and/or backrest shell.

When the cover is subjected to load, in particular when the cover is subjected to load in the direction of the seat opening and/or backrest opening or at least a plane in which the respective opening is located, the bending of at least one of the curved ribs is altered. In other words, with such a loading at least one of the curved ribs or a group of curved ribs is positioned relatively more raised and/or curved in the direction of the seat opening and/or backrest opening. For example, when the cover is subjected to load, which takes place substantially centrally between the curved ribs, opposing curved ribs are raised. Conversely, in particular when the loading takes place closer to a curved rib, said curved rib is bent away from the seat opening and/or backrest opening, whilst the opposing curved rib is bent in the direction of the seat opening and/or backrest opening. The same applies to sets of curved ribs.

Due to the flexibility of the curved ribs of the support shell and/or bearing shell, a force is exerted which counters the loading. By influencing the rigidity of the curved ribs and/or the support shell and/or bearing shell, said force may be adjusted. In this regard, reducing the rigidity has the same effect as an alteration of the cushion of a conventional seat, namely the replacement by a softer cushion.

By means of the seat according to the invention, on the one hand, particularly comfortable seating is permitted, even with a lateral inclination of a user without a relative movement of the back thereof relative to the backrest, so that in particular a so-called shirt pulling effect is reliably prevented.

On the other hand, due to the seat shell and/or backrest shell being adapted to the respective loading with the cover, active seating is made possible, as with every such load a force acts against the user who has to compensate for this. With a lateral inclination of the user, the simultaneous movement of the backrest, in particular in combination with a deformation of the seating surface and/or the seat, is perceived as particularly comfortable. The support shell absorbs or transfers the weight of the user. In a similar manner, the bearing shell absorbs and/or transfers the force acting on the backrest.

For example, the cross section of the curved ribs and/or the support shell and/or the bearing shell reduces from the seat opening and/or backrest opening toward the respective ends. This has the result that the force which counters a loading of the cover may be adjusted to the strength of the load if the curved ribs consist of only one material which, as a result, has a constant modulus of elasticity. By means of a suitable geometry of the curved ribs, therefore, for example with a relatively light load, the opposing force is disproportionally smaller than with a relatively large load.

Advantageously, the support shell and backrest shell are made from a permanently elastic material, in particular a suitable plastics material, for example glass fibers or carbon or a combination thereof. The cover is substantially non-stretchable, but advantageously flexible. For example, the material of the cover is a plastics material and the cover is, in particular, a plastics plate or a mesh consisting of plastics material. Optionally, a cushion is located on the cover in order to enhance the seating comfort. Alternatively, the cover is a woven fabric. Said woven fabric, in particular, comprises in the edge regions thereof, which are located in the vicinity of the free ends of the curved ribs, one or more tabs or a whipstitched edge which receives the free ends of the curved ribs and/or the peripheral shell outer edge, i.e. it encompasses said shell outer edge.

A seat mechanism may be designed to alter the seat shell (support shell) vertically and/or in terms of inclination, and to lock it in position in the respective position, and/or to permit a predefined movement. The seat shell may additionally be coupled to the backrest shell (bearing shell), in particular in the manner of a synchronous mechanism, such that with an inclination of the backrest to the rear and downward, the seat shell also carries out a synchronous movement at least to the rear. Moreover, when the bearing shell is used as a backrest, a user may influence a so-called lumbar support function of the backrest by bending the bearing shell, or adapt the contour of the bearing shell to the back or a desired position.

Figure 2A:
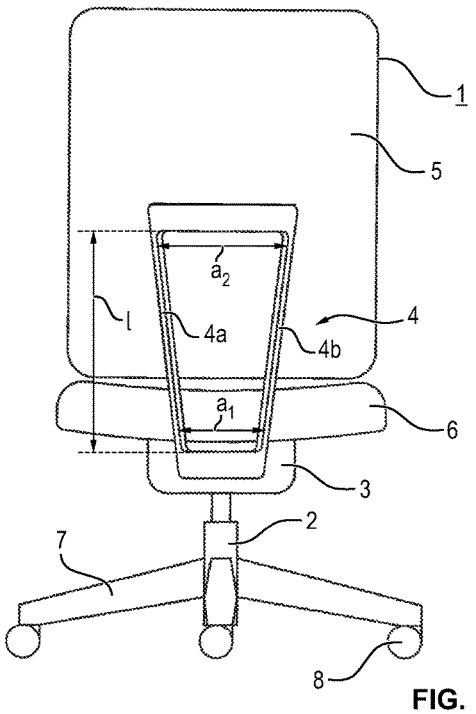
Figure 2B:
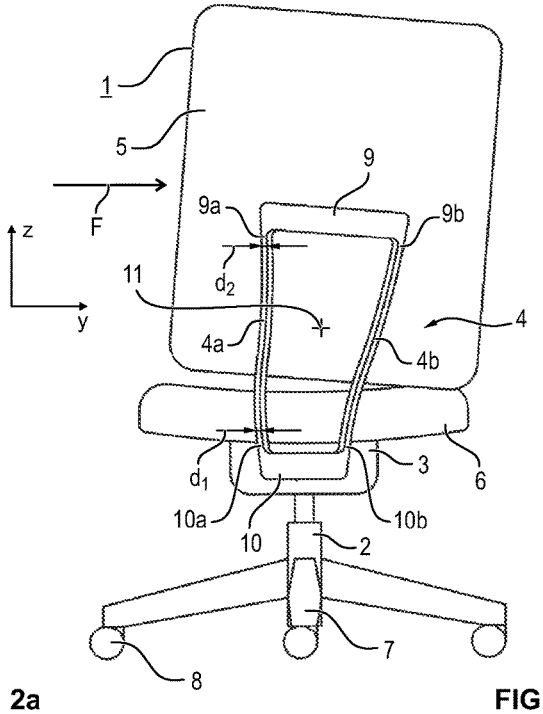
Figure 3A:
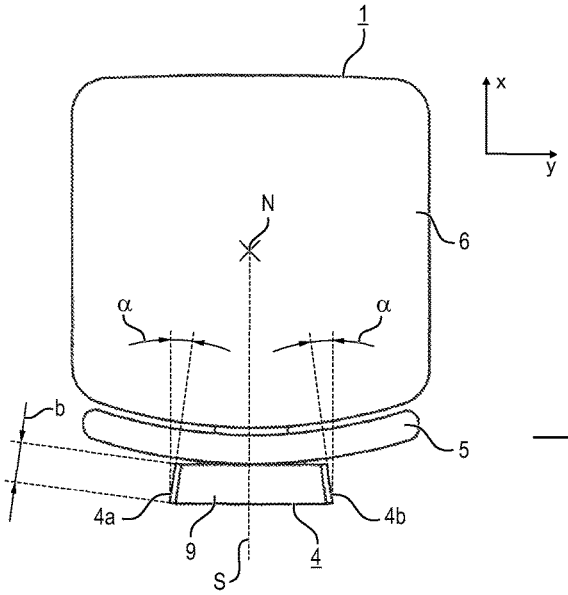
Figure 3B:
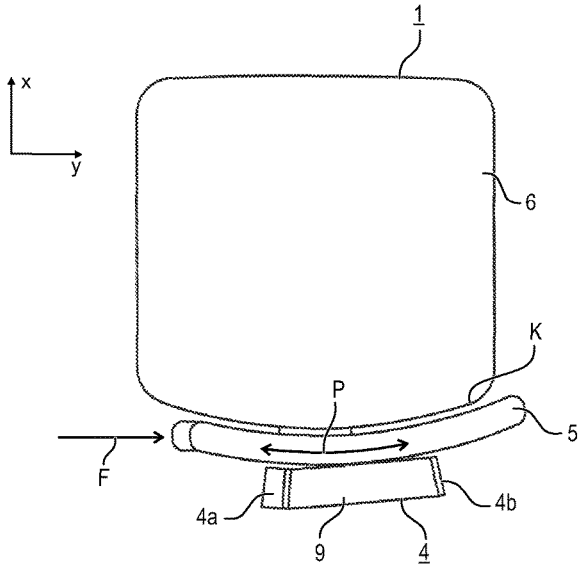
Figure 4A:
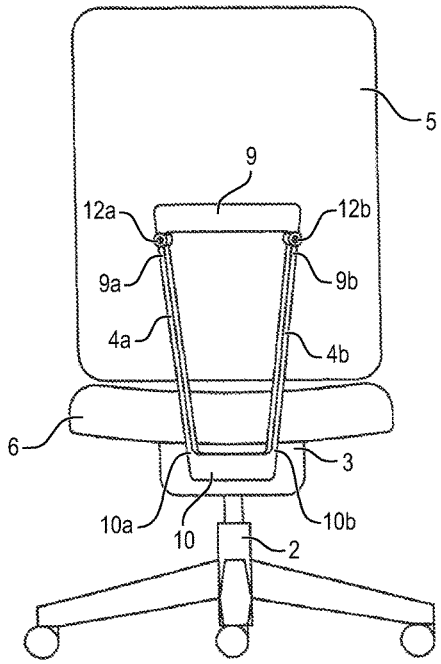
Figure 4B:
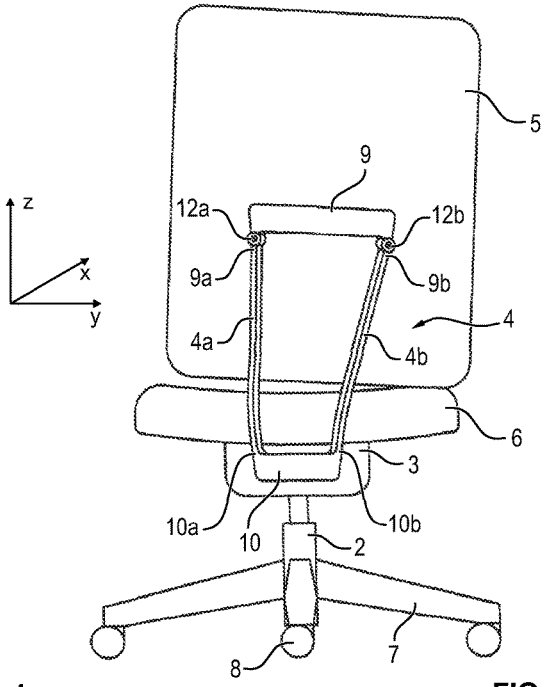
Figure 5A:
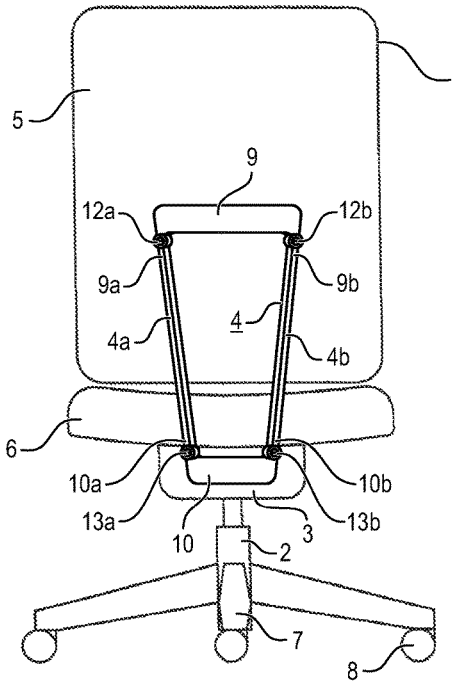
Figure 5B:
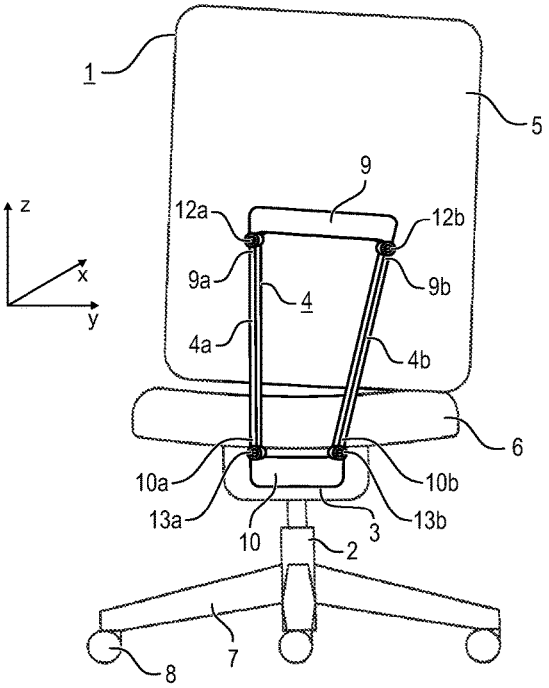
Figure 6A:
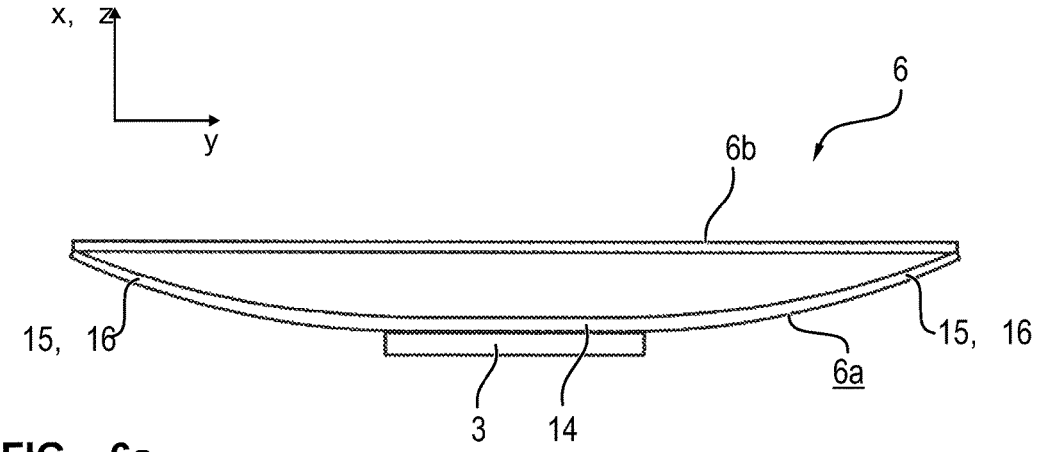
Figure 6B:
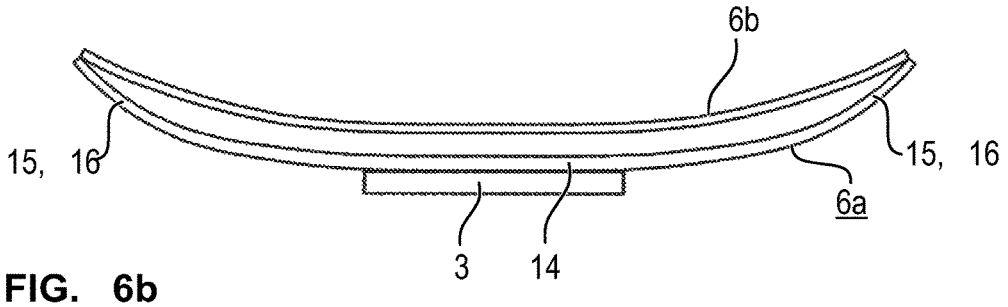
Figure 6C:
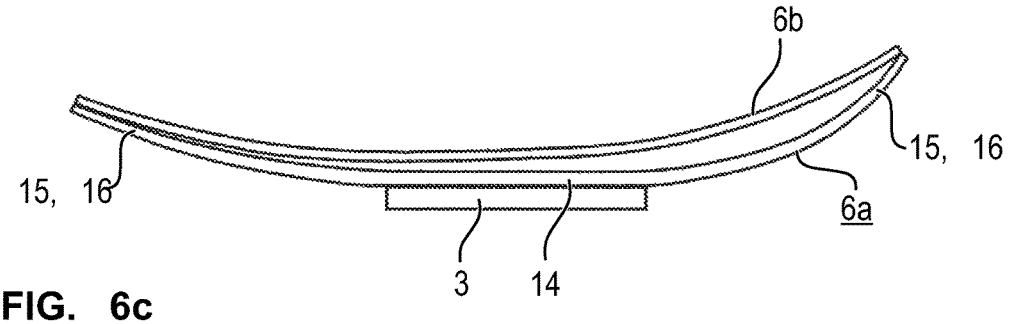
Figure 6D:
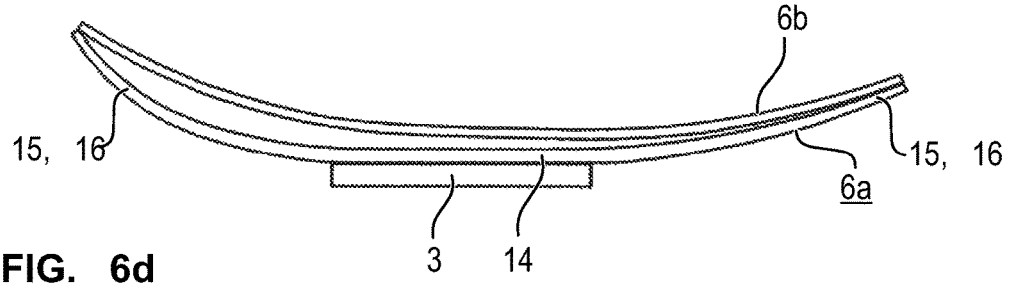
Figure 7:
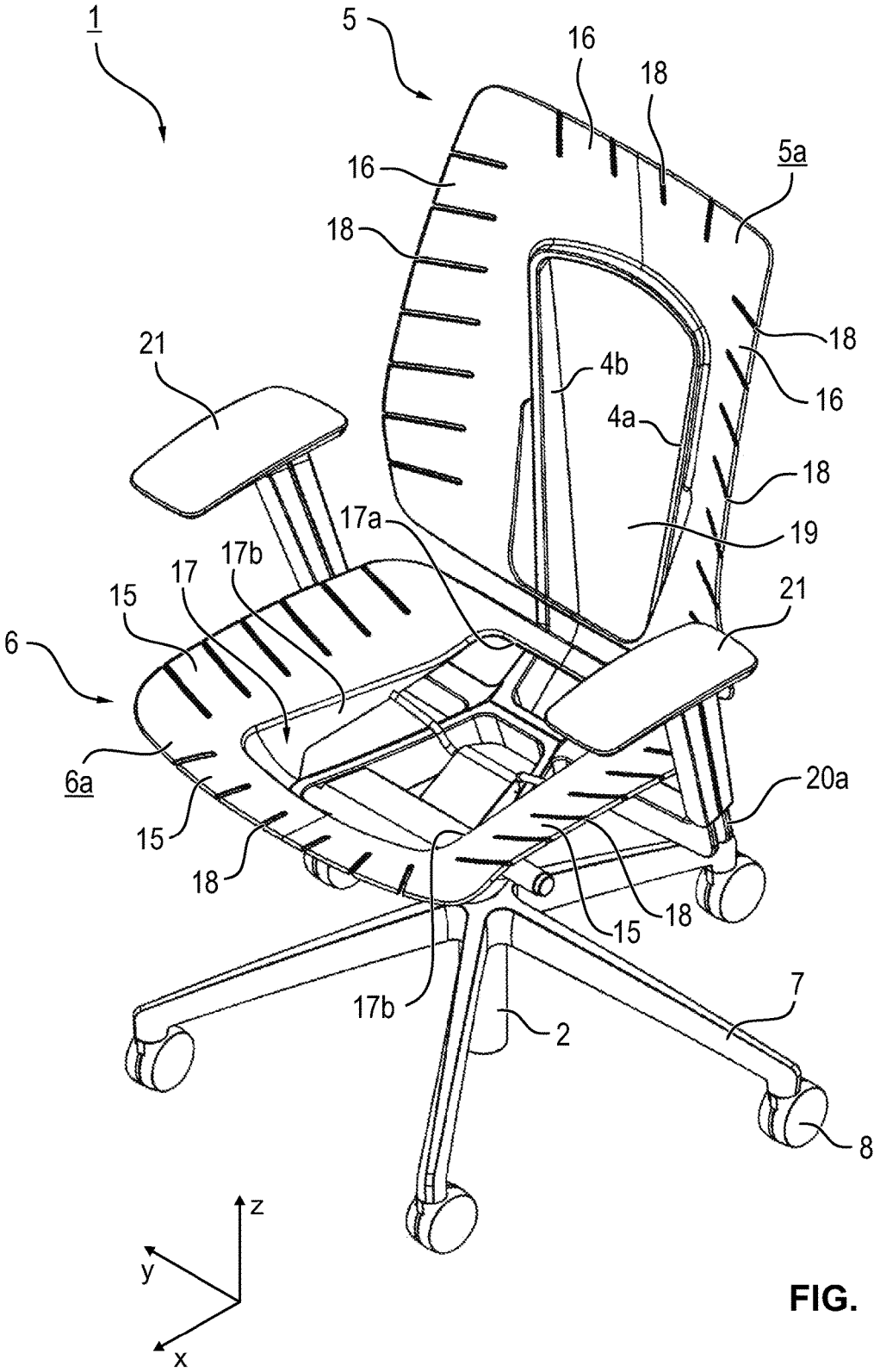
Figure 8:
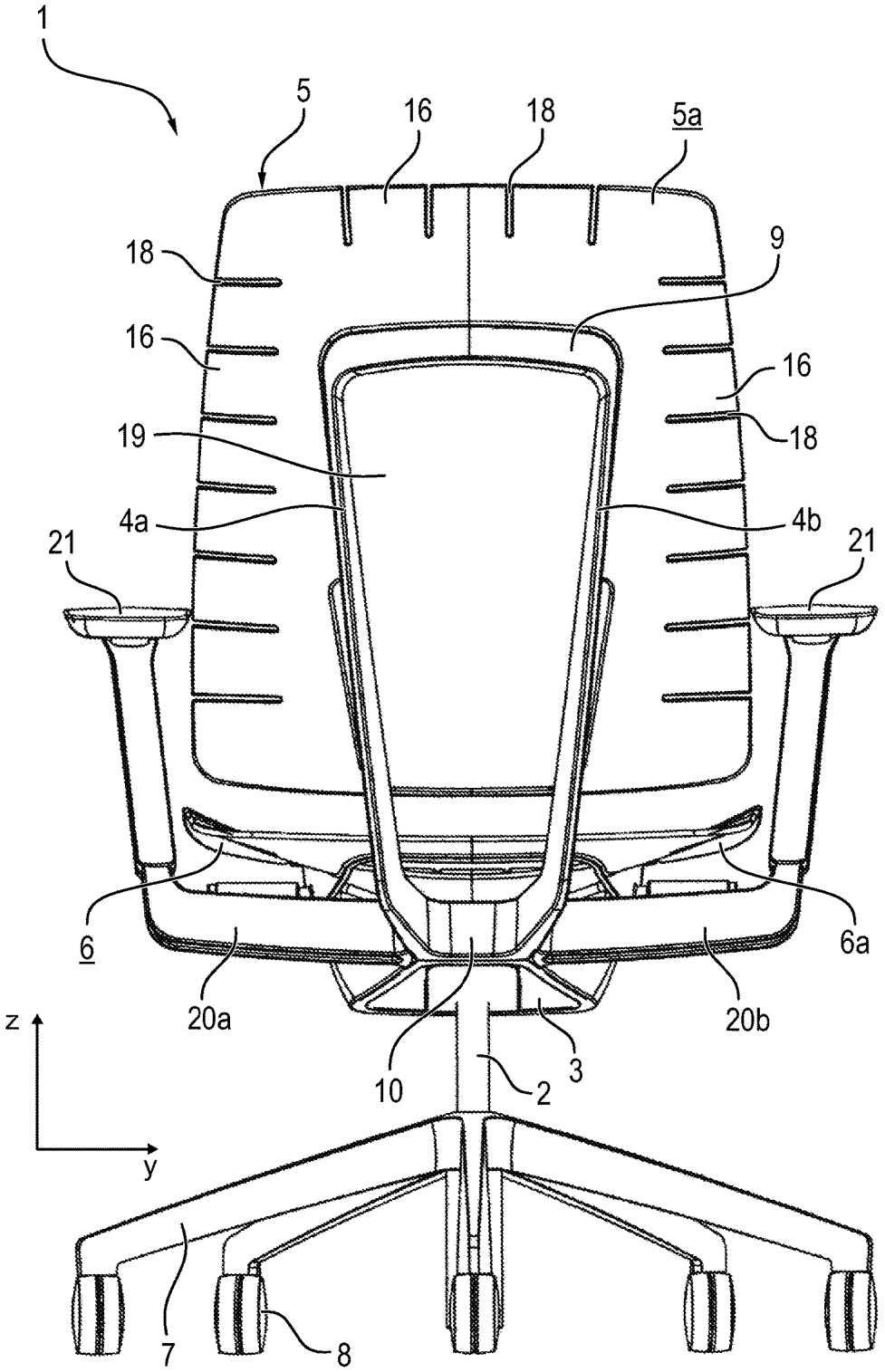
Figure 9:
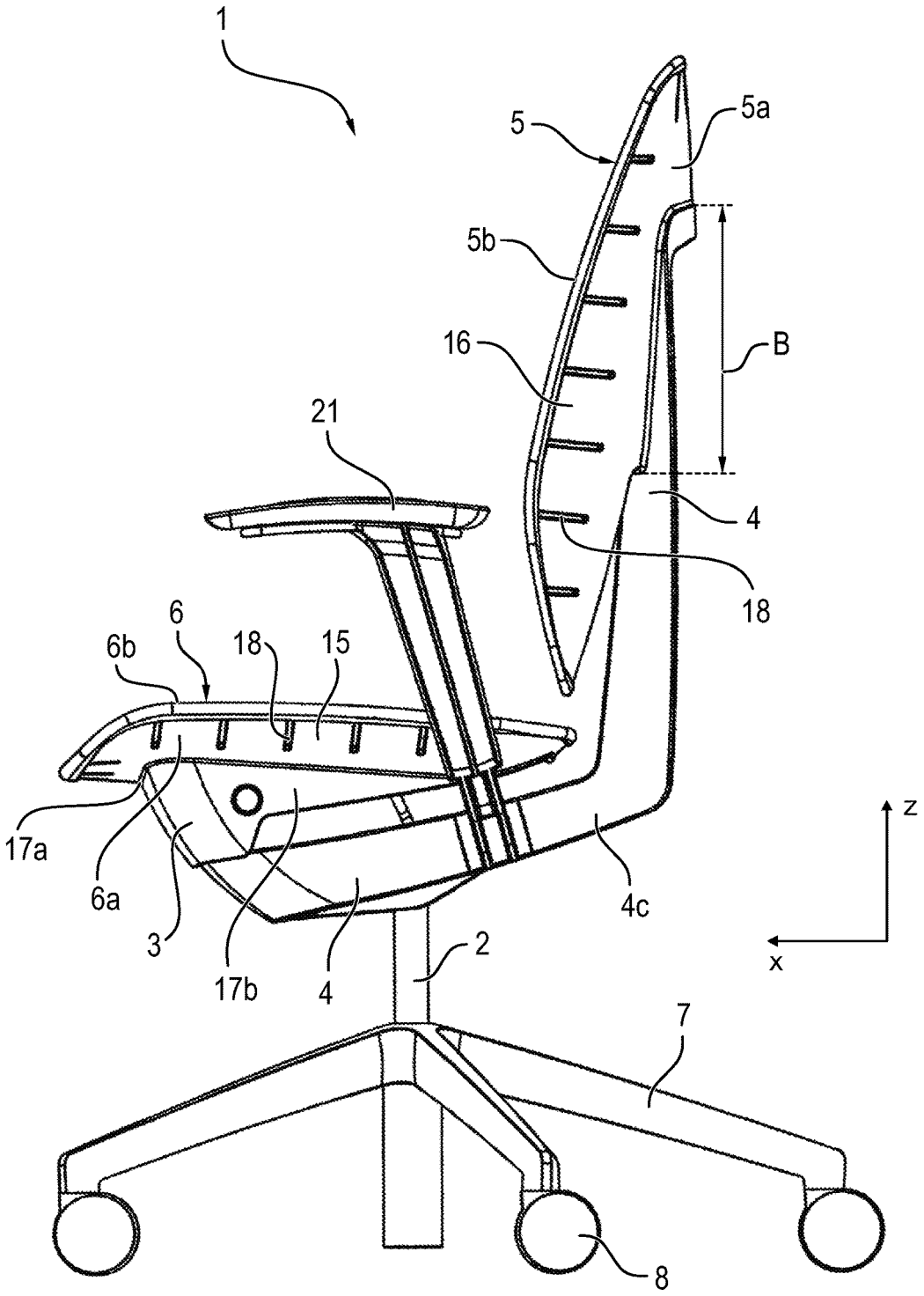
Figure 10:
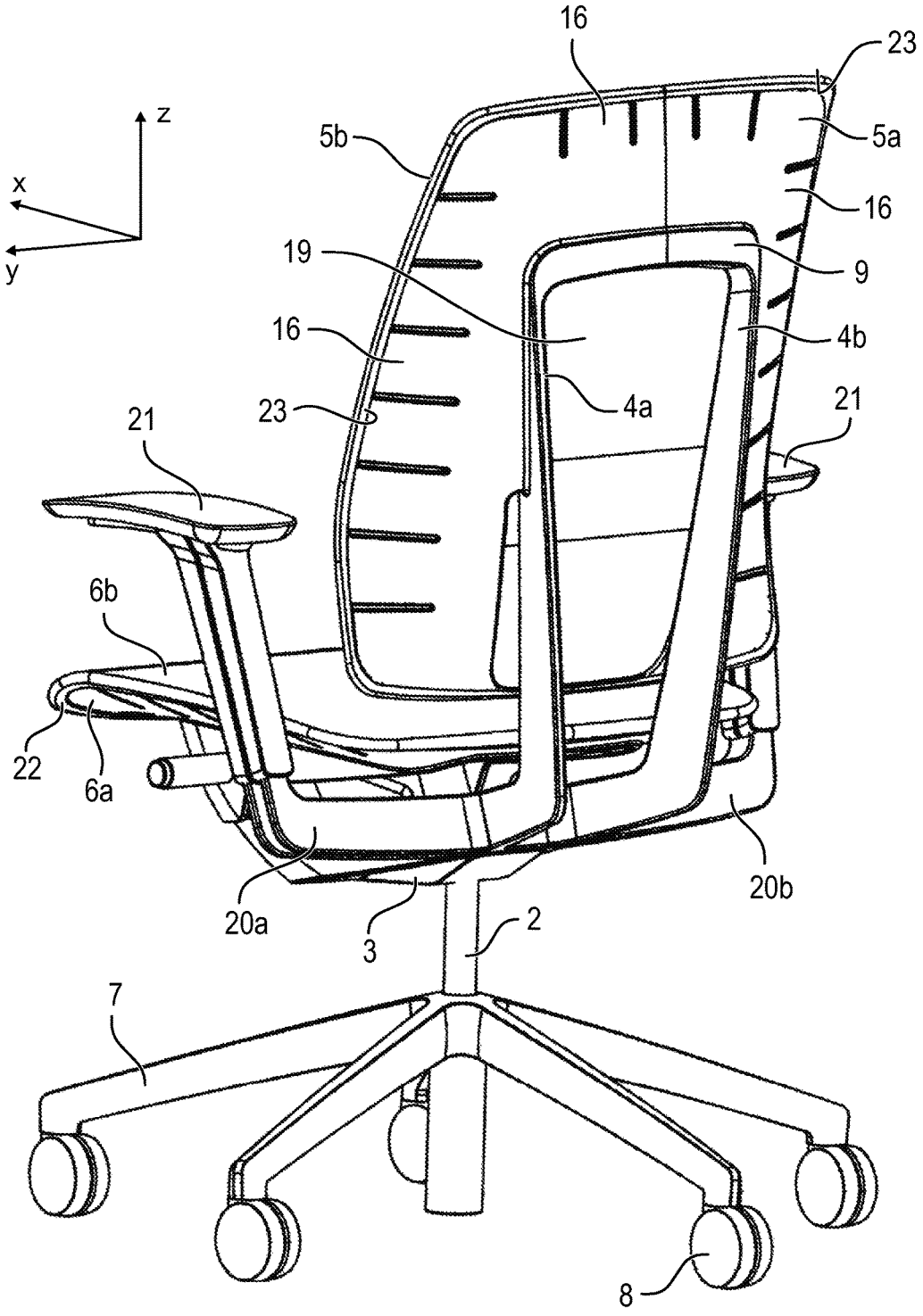

Exemplary embodiments of the invention are described in more detail hereinafter with reference to the drawings, in which:

FIG. 1 shows schematically in a side view an office chair as a seat comprising a seat support for a seat (seating surface) and comprising a backrest support of a backrest which may be inclined laterally, FIGS. 2*a* and 2*b* show the office chair according to FIG. 1 in a rear view with flexible support arms of the backrest support arranged in a V-shape in the initial position of the backrest and/or in a backrest position inclined to the right, FIGS. 3*a* and 3*b* show in a plan view the office chair according to FIGS. 2*a* and/or 2*b*, FIGS. 4*a* and 4*b* show in a view according to FIGS. 2*a* and 2*b* a variant with the support arms of the backrest support connected in an articulated manner on the backrest side, in the initial position and/or in the position of the backrest inclined to the right, FIGS. 5*a* and 5*b* show in a view according to FIGS. 2*a* and 2*b* an alternative of the variant comprising the support arms of the backrest support connected in an articulated manner on the backrest side and seat side, in the initial position and/or the position of the backrest inclined to the right, FIGS. 6*a* to 6*d* show in a sectional view a seat shell or backrest shell (support shell and/or bearing shell) with a cover as a seating surface and/or backrest surface under different loads, FIG. 7 shows in a perspective view the office chair in an embodiment of the seat shell and backrest shell without covers, FIG. 8 shows the office chair according to FIG. 7 in a rear view with support arms of the backrest support arranged in a V-shape and flanking a backrest opening to the side, in the initial position of the backrest, FIG. 9 shows the office chair according to FIGS. 7 and 8 in a side view with the seat cover and backrest cover, and FIG. 10 shows the office chair according to FIG. 9 in a perspective side view.

Parts corresponding to one another are provided in all the figures with the same reference numerals.

The seat 1 configured as an office chair according to FIG. 1 comprises a seat support 3 connected fixedly to a pedestal (base) 2, to which a backrest 5 is connected via a backrest support 4. A so-called synchronous mechanism may be incorporated in the seat support 3, said mechanism performing a synchronous movement of a seating surface (seat) 6 bearing on the seat support 3, with the backrest 5, when said backrest is deflected from the initial position shown into a position inclined to the rear. The seat support 3 and thus the seating surface and/or the seat 6 and the backrest 5 connected to the seat support 3 via the backrest support 4, are connected and/or coupled rotatably to the pedestal 2, which in the exemplary embodiment comprises three or four arms 7 with chair casters 8 fastened on the pivoting side at the end.

As may be seen from FIGS. 2*a* and 2*b*, the backrest support 4 comprises two support limbs, denoted hereinafter as support arms 4*a*, 4*b*, which are arranged relative to one another in a V-shape. The support arms 4*a*, 4*b* extend in the vertical direction z from the seat support 3 to a central region of the backrest 4. The connection of the support arms 4*a*, 4*b* and thus of the backrest support 4 to the backrest 5, i.e. on the rear face thereof, takes place via a connecting element 9 on the backrest side, which extends in the horizontal direction y. The support ends 9*a*, 9*b* of the support arms 4*a* and/or 4*b* on the backrest side are connected to said connecting element 9. In a similar manner, the support ends 10*a*, 10*b* of the support arms 4*a* and/or 4*b* on the seat side are connected by means of a connecting element 10 on the seat side.

In the exemplary embodiment shown, according to FIGS. 2*a* and 2*b*, the connecting element 9 on the backrest side and the connecting element 10 on the seat side are configured integrally with the two support arms 4*a* and 4*b*. Alternatively, also another type of rigid, in particular material, connection of the support arms 4*a*, 4*b* may be provided to the connecting elements 9, 10.

As a result of and/or for producing the V-shape of the arrangement of the two support arms 4*a*, 4*b*, the spacing $a_1$ thereof on the seat side is smaller than the spacing $a_2$ thereof on the backrest side relative to one another ($a_1<a_2$). The support arms 4*a*, 4*b* are made from a flexible material, for example from a correspondingly stable plastics material or a spring steel. Additionally, the support depth $d_1$ of the support arms 4*a* and 4*b* expediently decreases from the support ends 10*a*, 10*b* thereof on the seat side to the support ends 9*a* and/or 9*b* thereof on the backrest side continuously to a support arm depth $d_2$. The support arm depth $d_2$ on the support end 9*a*, 9*b* on the backrest side is thus smaller than the support arm depth $d_1$ on the support end 10*a*, 10*b* of the support arms 4*a* and/or 4*b* on the seat side ($d_2<d_1$).

As additionally illustrated with reference to FIGS. 3*a* and 3*b*, a lateral action of force F oriented in the horizontal y-direction, for example by a corresponding sidewards movement of a user of the office chair 1, leads to a lateral inclination or tilting of the backrest 4, in the exemplary embodiment shown, i.e. in FIGS. 2*b* and 3*b* in the y-direction to the right. The sidewards inclination of the backrest 4 takes place substantially in the yz-plane, wherein in particular as a result of the V-shaped arrangement of the support arms 4*a*, 4*b*, and the rigid connection thereof to the seat support 3 as well as the backrest 4 by means of the connecting elements 10 and/or 9 a rotation of the backrest 4 about a (virtual) rotational axis 11 located between the connecting elements 9, 10 is associated with the tilting or inclination.

The support arms 4*a*, 4*b* also extend in the direction x toward the seating surface 6 in a V-shaped and/or trapezoidal manner. The support arms 4*a*, 4*b* in this case extend in the direction x toward the seating surface 6 at an acute angle of inclination or trapezoidal angle $\alpha$ relative to one another. Relative to the Cartesian coordinate system shown, the seating surface 6 is located in the xy-plane and the backrest 5 extends accordingly in the z-direction. Thus the arm length l (FIG. 2*a*) of the support arms 4*a*, 4*b* extends in the z-direction and the arm depth d (FIG. 2*b*) of the support arms 4*a*, 4*b* in the y-direction, whilst the arm width b (FIG. 3*a*) of the support arms 4*a*, 4*b* is oriented in the x-direction.

In the view shown in FIGS. 3*a* and 3*b* it may be seen that the support arms 4*a*, 4*b*—relative to a mean perpendicular S to the normal N of the seating surface 6 extending between said support arms—extend at an angle $\alpha$ to one another.

The arm width b of the support arms 4*a*, 4*b* is greater than the arm depth $d_1$, $d_2$ thereof. As a result, it is achieved and/or ensured that as a result of a lateral action of force F the bending of the support arms 4*a*, 4*b* always takes place only in the y-direction and not in the x-direction.

The V-shaped path of the support arms 4*a*, 4*b* along the arm width b thereof toward the seating surface 6 leads to a circular movement of the backrest 5 indicated by the movement arrow P in FIG. 3*b*, as a result of the laterally oriented force or action of force F. The radius which is adapted, for example, to the curved contour of the backrest 5 and/or the edge of the seating surface K facing said backrest is such that the laterally displaced or tilting backrest 5 does not move toward or away from the seating surface 6, at least not perceptibly.

The embodiment of the backrest support 4 in the variant of the office chair 1 shown in FIGS. 4*a* and 4*b*, differs from that according to FIG. 2*a* and/or 2*b* by an articulated connection of the support arms 4*a*, 4*b* to the backrest 5 and/or to the connecting element 9 on the backrest side. To this end, the support ends 9*a*, 9*b* of the support arms 4*a*, 4*b* are connected to the connecting element 9 on the backrest side via rotary joints 12*a* and/or 12*b*. The connection of the support arms 4*a*, 4*b* on the seat side via the integral or material connection thereof of the support ends thereof 10*a* and/or 10*b* to the connecting element 10 on the seat side, corresponds to the embodiment according to FIGS. 2*a* and 2*b*. Accordingly, also in the variant according to FIG. 4*a* and/or 4*b*, the support arms 4*a*, 4*b* of the backrest support 4 are in turn at least flexible to this extent, at least in the application region on the seat side, i.e. in the connection to the connecting element 10 on the seat side.

In the variant according to FIGS. 5*a* and 5*b*, the support arms 4*a*, 4*b* of the backrest support 4 are connected both on the backrest side and on the seat side via rotary joints 12*a*, 12*b* and 13*a*, 13*b* to the backrest 5 and/or to the connecting element 9 at that point as well as to the seat support 3 and/or the connecting element 10 at that point. In this variant, rigid, i.e. flexurally rigid, support arms 4*a*, 4*b* may be used.

The mode of operation and inclination and/or tilting movement of the backrest 5 as a result of a force acting in the horizontal direction y, corresponds to the motion path of the variants shown in FIGS. 2*a* and 2*b* as well as 4*a* and 4*b*.

FIGS. 6*a* to 6*d* show in simplified sectional views the construction of a preferred embodiment of the seating surface and/or seat 6 with a support shell 6*a* denoted hereinafter as the seat shell, and a cover 6*b*. The seat shell 6*a* is indirectly or directly fixed to the seat support 3 via a central piece 14. In the horizontal direction y in each case a curved arm and/or a curved rib 15 is adjoined to the central piece 14. The curved ribs 15 may taper toward the respective free end thereof, the spacing thereof from the central piece 14 being the greatest. The curved ribs 15 are raised with their free ends in the z-direction. In other words, the curved ribs 15 at the free end side in the vertical direction z are spaced apart from the central piece 14. At the free end side, the cover 6*b* is attached to the curved ribs 15, said cover covering the central piece 14. The cover 6*b* consists of a non-stretchable material or at least a material which is relatively not easily stretchable. The cover 6*b* denoted hereinafter as the seat cover serves as the seating region of the seat and/or office chair 1. The curved seat shell 6*a* with and without the seat cover 6*b* is shown in relative detail in FIGS. 7 to 10.

In FIG. 6*b* a loading of the cover 6*b* in the downward direction is shown, i.e. a loading in the z-direction toward the central piece 14. The loading takes place in this case centrally in the y-direction. The cover 6*b* is curved (bulged) downwards. Due to the absent, or at least relatively low, stretchability of the cover 6*b* relative to the support shell, the flexible curved ribs 15 and specifically the free ends thereof are bent upward toward the central piece 14. Due to the elasticity of the curved ribs 15, a force acts counter to the bending thereof and thus against the loading. If the loading is generated by a user, a resilient action is present as the loading is generally not uniform, generally as a result of an at least partial movement of the user. This is perceived by the user as pleasant.

In comparison with FIG. 6*b*, in FIGS. 6*c* and 6*d* loading is shown which no longer takes place centrally in the y-direction but, for example, further to the left and/or to the right. The left or right curved rib 15 is not raised but bent downward, if the loading is relatively high or relatively far to the left and/or right. So that such bending usually does not take place or only takes place relatively seldom, the rigidity of the curved ribs 15 is relatively high and adapted to the weight of the user.

However, the right and/or left curved rib 15 is positioned relatively raised. Due to this asymmetry of the bending of the curved ribs 15, the cover 6*b* is also asymmetrically bulged inward so that by means of the cover 6*b* a type of incline is formed. The user, if the loading on one side is undesirable, is prompted to alter automatically the seating position again so that the loading is substantially central between the curved ribs 15, as shown in FIG. 6*b*. Also, it is possible for the user, if comfortable, to adopt a seating position with an asymmetrical loading of the cover 6*b*. To this end, the user does not have to carry out any adjustment to the seat 1. As a result, different users with variable seating preferences may use the seat 1 without an adjustment of the seat 1 having to be altered between each use thereof.

Due to the reaction of the curved ribs 15, on the one hand, as well as the inclination associated therewith of the backrest 5, on the other hand, the user feels a high degree of seating comfort, as neither hard resistance or edges may be felt on the inclined backrest 5 or on the deforming seat 6. Instead, due to the force applied by the curved ribs 15, it may be desirable for the user to alter continuously at least partially the seating position, wherein the backrest 5 always follows said position change.

Alternatively, the simplified construction shown in FIGS. 6*a* to 6*d* may also be a bearing shell 5*a* denoted hereinafter as the backrest shell with a cover 5*b* of the backrest 5, as shown in relative detail in FIGS. 7 to 10. The bearing shell 5*a* in turn comprises curved ribs 16. The curved ribs 16 of the backrest shell 5*a* are raised with their free ends in the x-direction. At the free end side, the cover 5*b* denoted hereinafter as the backrest cover, is attached to the curved ribs 16. The backrest cover 5*b*, in turn, consists of a non-stretchable material or a material which is at least relatively not easily stretchable.

FIGS. 7 to 10 show in different views a preferred, relatively structurally detailed view of the chair 1 without a cover (FIGS. 7 and 8) and with a cover 5*b*, 6*b* (FIGS. 9 and 10). As is relatively clearly visible from FIG. 7, the support shell or seat shell 6*a* comprises a central recess which forms a seat opening 17 on the shell base side.

Slots 18 opening onto the shell periphery side and extending toward the seat opening 17 are incorporated into the seat shell 6*a*. Between two of said slots 18, in each case a curved rib 15 is formed. On the opposing seat sides or shell sides, two curved ribs 16 are arranged diametrically opposing one another. On the front face or front side slots 18 are also incorporated into the seat shell 6*a*, wherein between two slots 18 a curved rib 15 is in turn formed. The rear face of the seat shell facing the backrest 5 is unslotted and thus relatively rigid relative to the slotted front face of the seat shell.

Supporting webs 17*a*, 17*b* are connected at the side to the seat opening 17 of the support shell 6*a*, which extend in the vertical direction z downward to a substantially horizontal L-shaped limb 4*c* of the backrest support 4. The backrest support 4 is to this end of L-shaped configuration with a substantially vertical L-shaped limb forming the support arms 4*a*, 4*b* and with the horizontal L-shaped limb 4*c*, which extends below the seating surface 6 in the x-direction. The supporting webs 17*a*, 17*b* are preferably connected in an articulated manner in the front region of the seat opening 17 remote from the backrest 5 to the horizontal L-shaped limb 4*c*.

Similar to the seat shell 6*a*, the backrest shell 5*a* of the backrest 5 is also provided with slots 18 on the peripheral side of the shell, and which open into the shell edges and extend toward a central recess and/or backrest opening 19. Between two slots 18 a curved rib 16 is formed, in turn. As in the seat shell 6*a*, two curved ribs 16 are also arranged opposing one another diametrically in the backrest shell 5*a*. Whilst the shell upper face of the backrest shell 5*a* is in turn provided with slots 18, the backrest underside of the backrest shell 5*a* facing the rear face of the seat shell 6*a* is unslotted.

As is relatively clearly visible from FIGS. 8 and 10, the support arms 4*a*, 4*b* extending in a V-shaped manner, as well as the connecting element 9 on the backrest side, flank the backrest opening 19 practically on three sides. The connecting element 10 on the seat side is located at an intersection with the substantially horizontal L-shaped limb 4*c* of the backrest support 4. The armrest supports 20*a*, 20*b* extending in the y-direction are attached here, on which armrests 21 which are adjustable in the z-direction are held. An inclination of the backrest 5 accordingly leads to a corresponding inclination of the armrests 21.

As visible from FIGS. 9 and 10, the seat cover 6*b* on the seat shell 6*a* is guided with a sufficient tension around the outer edges of the shell, forming a cover or fold-over edge 22 encompassing the seat shell 6*a* on the shell underside, and thus held reliably on the seat shell 6*a*. In a similar manner, the backrest cover 5*b* fully covering the backrest shell 5*a* is stretched around the outer edge thereof, forming a cover and/or fold-over edge 23 which encompasses the backrest shell 5*a* on the rear face of the backrest.

Whilst the seat shell 6*a* and the backrest shell 5*a* are preferably made from a flexible plastics material, the seat cover 6*b* and the backrest cover 5*b* expediently consist of a non-stretchable but sufficiently flexible woven material. The support frame 4*a*, 4*b* and the connecting element 9 on the backrest side are expediently integrally formed on the backrest shell 5*a*. In this case, the integrally formed region of the support arms 4*a*, 4*b* extends from the connecting element 9 on the backrest side, only over part of the arm length of the support arms 4*a*, 4*b*. The corresponding integrally formed region B of the support arms 4*a*, 4*b* on the backrest shell 5*a* is approximately a third, up to half, of the arm length of the support arms 4*a*, 4*b* extending in the vertical or z-direction.

| List of reference numerals | |
|---|---|
| 1 | Seat/office chair |
| 2 | Pedestal/base |
| 3 | Seat support |
| 4 | Backrest support |
| 4a, b | Support arm |
| 4c | Horizontal L-shaped limb |
| 5 | Backrest |
| 5a | Bearing shell/backrest shell |
| 5b | Backrest cover |
| 6 | Seating surface |
| 6a | Support shell/seat shell |
| 6b | Seat cover |
| 7 | Arm |
| 8 | Chair caster |
| 9 | Connecting element on backrest side |
| 9a, b | Support end on backrest side |
| 10 | Connecting element on seat side |
| 10a, b | Support end on seat side |
| 11 | (Virtual) rotational axis |
| 12a, b | Rotary joint on backrest side |
| 13a, b | Rotary joint on seat side |
| 14 | Central piece |

-continued

| List of reference numerals | |
|---|---|
| 15 | Curved arm |
| 16 | Curved rib |
| 17 | Seat opening |
| 17a, b | Supporting web |
| 18 | Slot |
| 19 | Backrest opening |
| 20a, b | Armrest support |
| 21 | Armrest |
| 22, 23 | Cover/fold-over edge |
| $a_1$ | Spacing on seat side |
| $a_2$ | Spacing on backrest side |
| b | Support arm width |
| d | Support arm depth |
| $d_1$ | Support arm depth on seat side |
| $d_2$ | Support arm depth on backrest side |
| l | Support arm length |
| B | Integrally formed region |
| F | Force/action of force |
| K | Seating surface edge |
| N | Seating surface normal |
| S | Mean perpendicular |
| α | Angle of inclination/trapezoidal angle |
| y | Horizontal direction |
| z | Vertical direction |

The invention claimed is:

1. A seat, in particular an office chair, comprising:

a seat support for a seating surface;

a backrest support coupled with the seat support, the backrest support comprising two support arms having upper ends connected by a connecting element, the support arms and connecting element defining a central opening;

a backrest cover; and a flexible shell extending outwardly from the support arms and the connecting element, the flexible shell defining at least a right peripheral side, a left peripheral side, and a top peripheral side, which collectively define a peripheral edge, the flexible shell extending from the support arms and the connecting element in the direction of the seat support, such that the peripheral edge is spaced forwardly from the backrest support in a direction adapted to engage or at least partially surround a user sitting in the seat;

wherein the backrest cover is supported on the peripheral edge of the shell, the backrest cover extending in the manner of a secant relative to the shell, wherein when the cover is loaded in a direction toward the flexible shell, a bending of at least a portion of the flexible shell is altered and at least one of the lateral sides of the shell bends toward the seating surface.

2. The office chair of claim 1 wherein the flexible shell is curved and extends at least partially between each of the two support arms and the backrest cover, the flexible curved shell extending convexly as viewed from a rear such that the shell forms a concave forward surface of the backrest shell toward the seating surface.

3. The office chair of claim 2 wherein the backrest support is coupled with the seat support so as to be able to move relative to the seat support.

4. The office chair of claim 3 wherein the support arms are connected at a lower end by a lower connecting element, and wherein the connecting element and the lower connecting element each extend in a horizontal direction, the support arms, connecting element and lower connecting element collectively defining a trapezoidal shape.

* * * * *